US006626116B2

(12) United States Patent
Clark, Jr. et al.

(10) Patent No.: US 6,626,116 B2
(45) Date of Patent: Sep. 30, 2003

(54) OUTLAW POWERSLIDERS TOY RACING VEHICLES

(76) Inventors: Leonard R. Clark, Jr., 128 Weldy Ave., Oreland, PA (US) 19075; H. Peter Greene, 12 Wards Way, Boyertown, PA (US) 19512

( * ) Notice: Subject to any disclaimer, the term of this patent is extended or adjusted under 35 U.S.C. 154(b) by 108 days.

(21) Appl. No.: 09/750,121

(22) Filed: Dec. 29, 2000

(65) Prior Publication Data

US 2001/0029865 A1 Oct. 18, 2001

Related U.S. Application Data

(60) Provisional application No. 60/174,840, filed on Jan. 7, 2000.

(51) Int. Cl.[7] ..... A63G 1/00
(52) U.S. Cl. ..... 104/60; 104/140; 238/10 F
(58) Field of Search ..... 104/60, 305, 244.1, 104/296, 140; 238/10 F; 446/440, 441, 431, 444, 446, 460, 465, 454

(56) References Cited

U.S. PATENT DOCUMENTS

| | | | | |
|---|---|---|---|---|
| 2,687,304 A | | 8/1954 | Northrop et al. | 463/62 |
| 2,703,534 A | * | 3/1955 | Copeland | 104/140 |
| 2,866,418 A | | 12/1958 | Petrick, Sr. | 104/305 |
| 3,016,024 A | | 1/1962 | Silver | 104/305 |
| 3,048,124 A | | 8/1962 | Lovell | 104/305 |
| 3,159,109 A | | 12/1964 | Braverman | 104/305 |
| 3,596,397 A | * | 8/1971 | Colletti | 446/446 |
| 3,871,129 A | * | 3/1975 | Tong | 446/437 |
| 4,136,485 A | * | 1/1979 | Jones et al. | 446/446 |
| 4,155,197 A | * | 5/1979 | Beny et al. | 104/60 |
| 4,163,555 A | * | 8/1979 | Norwalt et al. | 104/60 |
| 4,187,637 A | * | 2/1980 | Nielsen | 446/444 |
| 4,438,590 A | * | 3/1984 | Lee | 446/438 |
| 4,795,154 A | * | 1/1989 | Lahr | 238/10 F |
| 4,892,502 A | * | 1/1990 | Hesse | 446/444 |

FOREIGN PATENT DOCUMENTS

| | | |
|---|---|---|
| FR | 1344283 | 10/1963 |
| GB | 957239 | 6/1964 |
| GB | 2096905 A | 1/1982 |

* cited by examiner

*Primary Examiner*—S. Joseph Morano
*Assistant Examiner*—Lars A. Olson
(74) *Attorney, Agent, or Firm*—Michael de Angeli

(57) ABSTRACT

A toy racing car or other vehicle for operating on conventional track of a given scale a comprises a sub body, including a chassis, motor and gear set, pickup shoes and drive wheels, and a visible body of much larger scale, with large scale rear drive wheels. In one embodiment, the body is pivoted to the sub body, so as to swing outwardly in turns, simulating a broadsliding race car; large scale front wheels are carried by the sub body, so as to simulate countersteering. A toy motorcycle similarly comprises a sub body and modeled motorcycle components; the front wheel and fork of the motorcycle remain upright in turns, while the rider and frame lean over, simulating a motorcycle leaning in a turn.

17 Claims, 4 Drawing Sheets

OUTLAW POWERSLIDERS TOY RACING VEHICLES

CROSS-REFERENCE TO RELATED APPLICATION

This application claims priority from Provisional Application Ser. No. 60/174,840, filed Jan. 7, 2000.

FIELD OF THE INVENTION

This invention relates to toy racing cars and other vehicles. More particularly, the invention relates to toy racing cars, trucks, and motorcycles having improved realism and better play value than prior toy racing equipment.

BACKGROUND OF THE INVENTION

The prior art shows numerous types of toy and model racing cars, trucks, and motorcycles adapted to run on tracks.

Typically such "slot cars" have a guide pin or fin extending downwardly into a groove or "slot" formed in the track, which is commonly molded in plastic and provided in sectional, snap-together form. Such slot cars are typically propelled by DC motors driving their rear wheels. The motors are connected to "pick-up shoes" that slide along the upper surfaces of conductors disposed on or slightly proud of the track surface, on either side of the groove; the current supplied is varied to control the speed of the slot car. As far as known to the present inventors, any body provided (i.e., to resemble a particular model of car, truck or motorcycle) is normally intended to be fixed to the chassis which carries the motor, guide pin or fin, drive wheels, and pick-up shoes.

One relevant prior art toy race car intended to run on a grooved track is shown in U.S. Pat. No. 3,159,109 to Braverman.

Braverman shows a toy racing car having a motor comprising an armature mounted between two pole pieces and driving a rear axle of the car through a ring and pinion gearset. The magnets providing the magnetic field necessary for motor operation are confined between the pole pieces. This design appears to correspond generally to that of toy race cars as extensively marketed in approximately "HO" scale (i.e. 3.5 mm=1 foot) by Mattel Corporation. However, the Mattel cars are usually intended to run on a track having steel conductors, so that the magnets forming part of the motor, as above, attract the car toward the track surface, providing improved roadholding ability. Braverman suggests (col. 4, lines 55–60) that his conductive rails could be made from aluminum or brass in addition to steel, which would eliminate this feature.

Braverman also teaches that his cars are to be guided along the groove or slot in the track by "an irregularly shaped, vertically oriented plate" which is pivoted vertically with respect to the car, "to create a skidding effect" (col. 8, lines 24–39). That is, as the toy racing car traverses a turn it experiences centripetal force. As the outward movement of the front of the car is restrained by the guide plate in the groove, but the rear end of the car's motion outwardly is not similarly constrained (since as noted the guide plate is pivoted with respect to the chassis), the tail of the car swings outwardly, creating a "broadsliding" or "oversteering" appearance. The Mattel cars are guided by a generally cylindrical guide pin that is fixed to the chassis and rides in the slot, so that the skidding effect mentioned by Braverman is obtained. As will appear below, certain Mattel components can advantageously be employed in one embodiment of the present invention.

Additional known prior art includes U.S. Pat. No. 2,866,418 to Petrick, U.S. Pat. No. 2,687,304 to Northrop, U.S. Pat. No. 3,048,124 to Lovell, and U.S. Pat. No. 3,016,024 to Silver, British patent 957,239 to Steedman et al, and French patent 1,344,283 to Lepicard, showing various aspects of toy race cars or other vehicles principally intended to run on tracks. Lovell in particular shows a steering mechanism operated by a "guide boss" fitting into a groove in the track so as to "simulate very realistically the skidding of a full sized vehicle properly handled, such as the 'broadsliding', of a racing car around a turn." Col. 1, lines 29–30. Thus the art acknowledges the play value of a toy racing car properly simulating the spectacle of a racing car broadsliding (or "oversteering") through a turn.

The art also recognizes the improved toy value provided to a toy motorcycle adapted to run on a track if it is arranged so that the toy motorcycle leans inwardly in turns, as do full size motorcycles. This is suggested by published British patent specification 2,096,905 to Nagasaki, which discloses such a toy motorcycle incorporating a rather complex linkage including at least two guide pins riding in a groove in the track; as the toy encounters a curve in the track, a forward guide pin is forced out of its prior alignment, and the force thus exerted operates the linkage to lean the toy motorcycle towards the inside of the curve.

It is generally understood that the small size of the popular HO scale toy racing cars, e.g., as sold by Mattel, limits their toy value in several significant ways. One is simply that the small size of the toys makes it harder to see them than is the case with larger models, particularly given their very high speeds. Larger slot cars provide better play value, and of course these have been and are still available. Larger scale cars also provide more surface area for colorful paint schemes, simulating actual race cars that may be marketed as collector's items, and so forth. However, larger scale cars and their track cost more and take up much more space, and so the HO scale cars retain their popularity. There is also a large "installed base" of preexisting HO scale track and associated equipment. Accordingly, it would be desirable to provide larger cars that could run on existing HO scale track; of course, it would be trivial to make the cars slower, increasing their visibility, but heretofore there has been no suggestion of any way to make them larger and still allow them to run on HO scale track, particularly if they are to be able to overtake one another, as required for realistic racing action.

OBJECTS OF THE INVENTION

It is therefore an object of the invention to provide toy race cars and other vehicles that are larger than HO scale, yet which run on HO scale track, and allow overtaking.

It is a further object of the invention to provide toy race cars and other four-wheel vehicles that provide a realistic broadsliding or oversteering appearance in turns, and toy motorcycles that provide a realistic leaning action in turns, without requiring complex linkages or steering mechanisms that would involve excessive cost, complexity, and unreliability.

It is yet a further object of the invention to provide toy race cars and other vehicles that achieve the above objects while being manufacturable using essentially standard toy car components, to reduce incremental tooling costs.

SUMMARY OF THE INVENTION

The Outlaw Powersliders concept of the invention includes several different versions of cars, trucks, and motorcycles, all able to run on standard HO scale slot-car track and using essentially unmodified HO slot car chassis, but allowing much larger bodies to be used, and providing much improved racing action. Four embodiments of such vehicles, each involving somewhat different versions of the concept, are shown in the attached drawings.

The Sprint Car shown in side view by FIG. 1 illustrates the basic concept of the vehicles according to the invention, and FIG. 2, a plan view showing two of the FIG. 1 Sprint Cars rounding a turn, illustrates the improved play value provided thereby. In the preferred embodiments shown in detail herein, components of standard HO slot cars, including the chassis, motor and gear set, pickup shoes, drive wheels, and guide pin, are used as a "sub body", and standard drive wheels propel the vehicle. Standard HO track can be used as the road surface. A second guide pin riding in the same groove in the track may be employed, to ensure the sub body stays on track. A much larger-scale visible body carrying dummy wheels rotated by drag along the track is attached to the sub body at a vertical pivot axis. As shown in FIG. 2, when the car goes around a turn, the sub body stays on track, but the rear of the visible body swings outwardly, simulating broadsliding or oversteer. Drag from the rear dummy wheels brings the body back into line when the car goes along a straight section of the track. Thus very realistic racing action is provided; car bodies much larger than HO scale can be used, improving the visual effect, while the motion of the vehicles is also very prototypical, and exciting for both driver and spectator.

FIGS. 3 and 4 shows two different embodiments of Monster Truck toy cars, illustrating further variations on the theme of the Sprint Car of FIG. 1. The Monster Truck I of FIG. 3 is functionally similar to the Sprint Car, with variations discussed below. In the Monster Truck II, the vertical pivot between the sub body and visible body is eliminated, as is the second guide pin. Therefore the entire vehicle swings outwardly in turns. The visible rear wheels are mounted on an axle in a slot, so that they do not interfere with the traction of the drive wheels of the sub body, for example, if there are any high spots on the track. The Monster Truck II also allows for a shorter-wheelbase model, since in this case the rear wheels can overlap the sub body.

A Motorcycle according to the invention is shown in FIGS. 5 and 6. In the Motorcycle, the front wheel and fork do not pivot with the rider, frame and rear wheel; instead, the front wheel and fork meet the rest of the Motorcycle at a pivot inclined at an angle comparable to the steering-head axis of a conventional motorcycle. In a turn the front wheel of the Motorcycle (typically two thin discs spaced by a bracket fixed to the sub body) and the front fork stay essentially vertical while the frame, rider, and rear wheel are leaned over, just as a power-sliding motorcycle, creating great visual interest.

BRIEF DESCRIPTION OF THE DRAWINGS

The invention will be better understood if reference is made to the accompanying drawings, in which.

DESCRIPTION OF THE PREFERRED EMBODIMENTS

Figure 1:
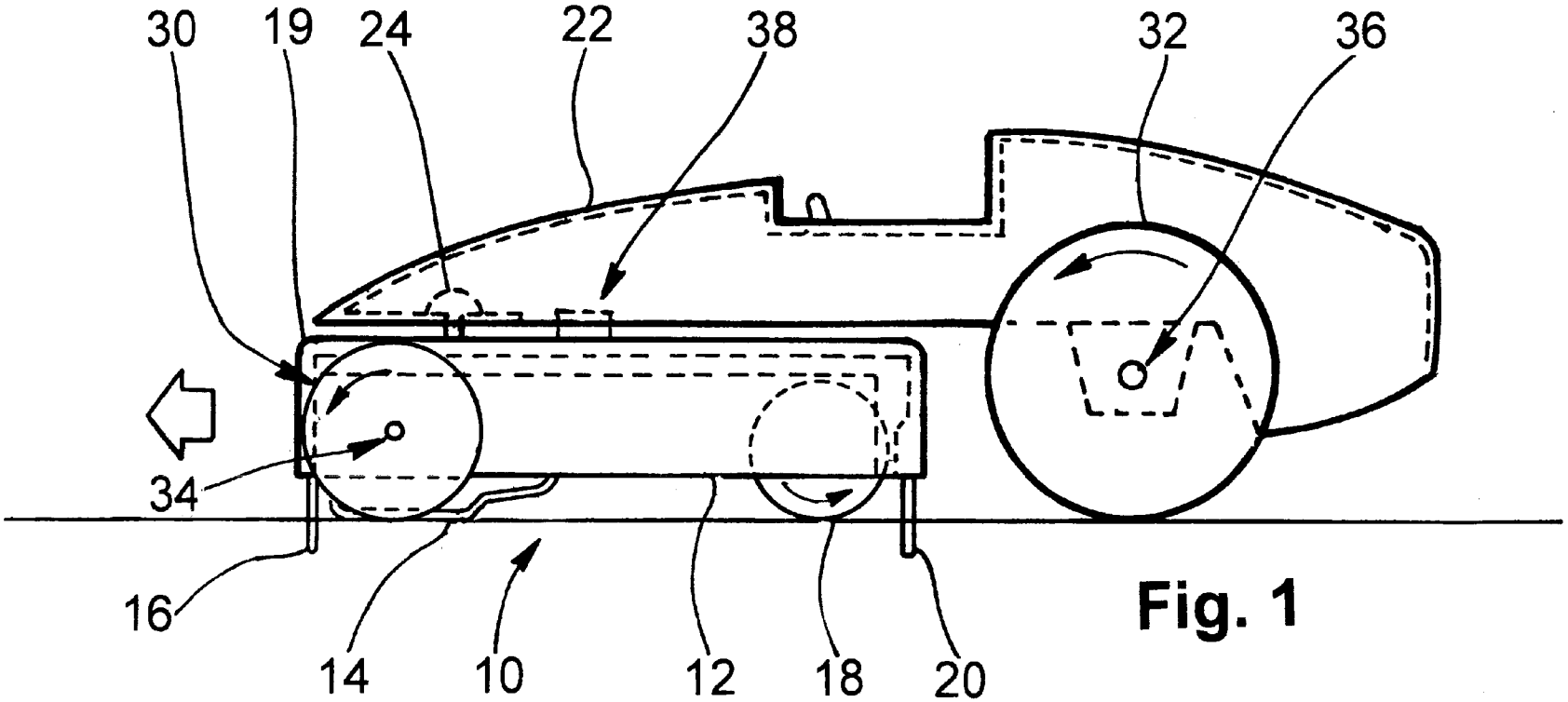
FIG. 1 shows a side view of the Sprint Car, illustrating a first implementation of the invention.

FIG. 1 shows a first embodiment of the invention, in this case showing a toy Sprint Car. Two such cars are shown in plan view in FIG. 2 negotiating a curve. Each car comprises a "sub body" 10 essentially comprising a chassis 12, pickup shoes 14, motor 15, gear set 17, forward guide pin 16, and drive wheels 18.

These components may all be essentially conventional, for example as sold by Mattel Corporation as part of their existing line of "HO" scale toy race cars. According to one aspect of the invention, a second guide pin 20 may be added at the rear end of chassis 12; in use, the second guide pin 20 provides additional cornering stability, that is, assists in keeping the car on the track during vigorous cornering, and ensures that the sub body does not swing outwardly during cornering, which is important to the appearance of some of the embodiments of the invention in use.

As noted, in the embodiment shown the drive components are essentially as marketed for HO scale (i.e., 3.5 mm=one foot), in which typical cars are less than three inches long. The visual appeal of such small cars is rather limited; more particularly, technical advances in the motors and tires, and particularly in using the motor magnets to also provide "downforce" pulling the cars down onto the track (by magnetic attraction between the magnets and the conductors 66 (see FIG. 6) used to supply power to the motors by way of the pickup shoes) have rendered HO cars so fast that it is sometime difficult to appreciate the appearance of the cars as they traverse the racetrack. It would be desirable to provide larger cars which could be operated on the "installed base" of HO track and associated equipment already in existence, to avoid additional tooling costs as would be required to market larger cars and larger track. Larger track also requires more space, limiting the market for larger-scale products.

Figure 2:
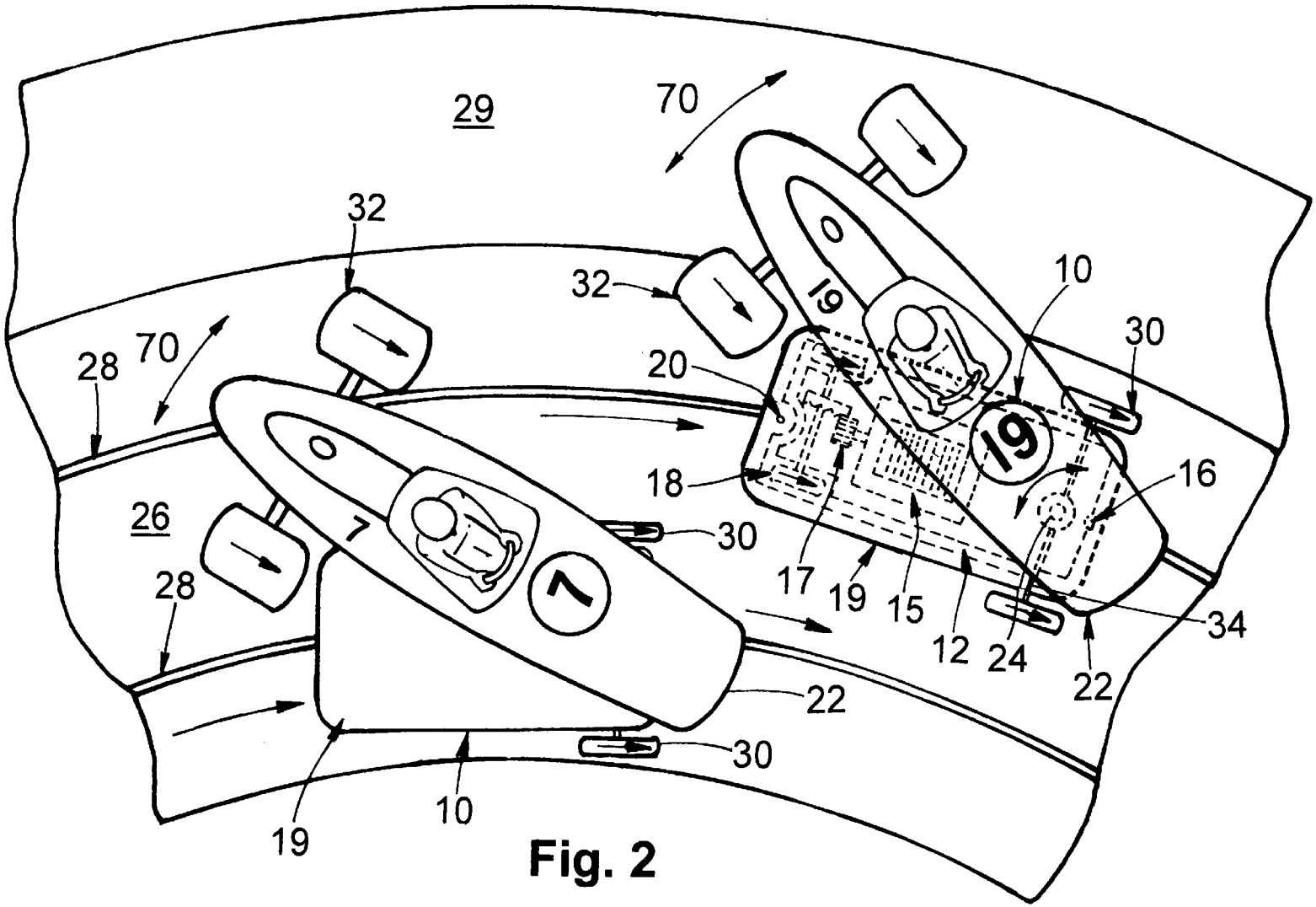
FIG. 2 shows a plan view of two of the Sprint Cars of FIG. 1 being operated around a curve on a track, illustrating the racing action made possible according to the invention.

In use the Monster Truck I operates much as the Sprint Car of FIGS. 1 and 2; in turns, the visible body 22' and rear wheels 32 swing outwardly, while the front wheels 30 remain aligned with the sub body 10 and hence the direction of travel, providing a very pleasing impression of a broadsliding truck being countersteered to remain under control.

Thus, as illustrated by FIG. 1, a much larger scale "visible" body 22, which may be four or more inches long, is attached to the basic HO scale chassis, as are pairs of relatively large-scale front wheels 30 and rear wheels 32. In the embodiment illustrated, the visible body 22 is made to resemble a Sprint Car, i.e., an open-wheeled race car; obviously numerous alternatives are possible, and several are discussed below. In the FIG. 1 embodiment, the Sprint Car body 22 is attached to the sub body 10 by a pivot pin 24 defining a vertical axis, so that the visible body 22 can pivot freely with respect to the sub body 10 about the vertical axis. In this embodiment, the large scale front wheels rotate freely about an axle 34 carried by the sub body 10, while the large-scale rear wheels 32 rotate freely about an axle 36 carried by the Sprint Car body 22. The drive wheels 18 carried by the chassis 12 of the sub body 10, and driven by the motor 15 and gear set 17 thereof (see FIG. 2) bear against the track surface and propel the car along the track; these "working" rear wheels 18 are unobtrusive and not readily seen while the toy car is running. The sub body may be largely concealed by a shrouding box 19 formed of plastic of an unobtrusive color (e.g., matching the color of the track) so as to further reduce its visual impact. By comparison, the large-scale front and rear wheels 30 and 32 are undriven "mockups"; they are made freely rotating, so as to be readily rotated by friction as they contact the surface of the track, providing the appearance of motion.

As mentioned, FIG. 2 illustrates a plan view of two of the Sprint Cars running on a conventional curved section 26 of track including paired guide slots 28. Conventional HO track sections can be fitted with snap-on outside berm sections 29 in order to widen the track and support the larger-scale cars provided according to the invention. As illustrated, as a toy car according to the invention travels through the curve, the guide pin(s) 16 (and 20, if fitted), fitting within the groove 28, keep the sub body 10 generally aligned with the curve.

As noted, in the embodiment shown the large-scale front wheels 30 are fixed to axle 34 carried by chassis 12, and therefore remain aligned with the direction of travel of the car around the curve in the track. As the car goes around a curve, it experiences centripetal force; the pivot pin 24 restrains the front end of the body 22 against the centripetal force. However, as the visible body 22 of the Sprint Car is freely pivoted with respect to chassis 12 at pivot pin 24, unrestrained centripetal force acting on the rear of the car body causes it and the large-scale rear wheels 32 carried thereby to swing outwardly, simulating a broadsliding or oversteering race car traversing a corner. As the large-scale front wheels 30 remain aligned with the direction of travel as noted, a very realistic appearance of countersteering, as is normally required to keep a sliding car under control, is provided. A stop 38 may be fixed to the sub body 10 and fit within a recess formed in the underside of the visible body 22, to limit the angular excursion of the visible body 22 with respect to the sub body 10. The underside of the front of the visible body 22 is cut away so that the front wheels 30 fit under the body 22 when it swings outwardly in a turn, as illustrated.

When the car reaches a straight section of track the drag provided by the large-scale rear wheels 32 causes the visible body 22 to become aligned with the direction of travel of the sub body 10, further adding to the attractive simulation of a racing car.

As will be appreciated, the larger-scale cars shown are capable of running on HO scale track (of course the invention is not limited to HO scale) by virtue of their using HO scale mechanisms; this also has obvious advantages in allowing use of preexisting tooling for manufacture of the sub bodies and the track itself. Racing, specifically passing, is still possible as the visible bodies are not mounted rigidly on their sub bodies, alowing one car to pass another, even if they make contact, without dislodging the sub bodies from the track; that is, the cars of the invention are more tolerant of such contact than are standard HO scale cars. Stated differently, even though, as shown in FIG. 2, the larger-scale visible bodies provided according to the invention overlap the lanes provided by standard track, particularly on turns, the fact that they are freely pivoted with respect to their sub bodies, which do not overlap their lanes, allows the visible bodies to bump in passing without necessarily knocking one or both cars off the track. This fact, especially when combined with the significantly enhanced visual effect provided by the larger-scale visible bodies, provides significantly better racing action and increased play value.

Figure 3:
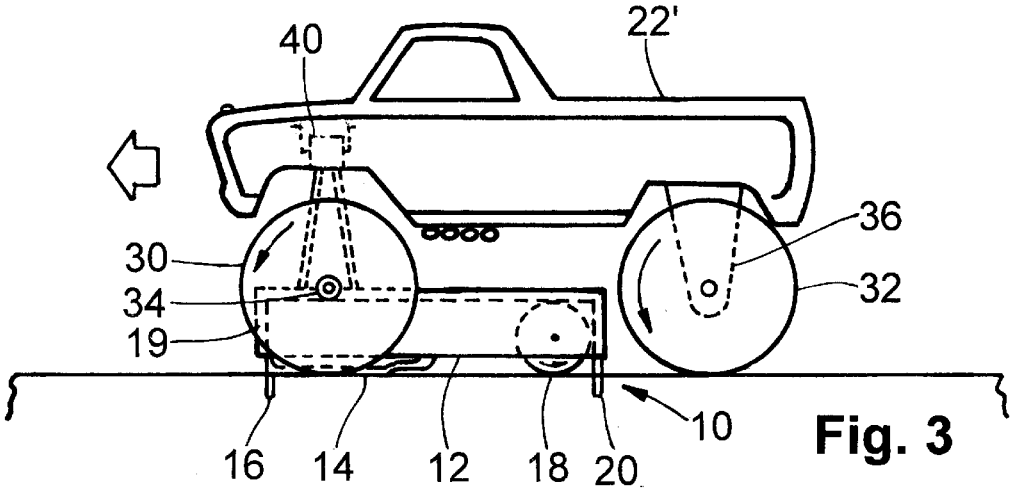
FIG. 3 shows a side view of the Monster Truck I, illustrating a variation on the first implementation of the invention.

FIG. 3 shows a variation on the embodiment of the invention exemplified by the Sprint Car of FIGS. 1 and 2. The Monster Truck I of FIG. 3 again comprises a sub body 10, essentially comprising a standard HO chassis 12, pickup shoes 14, motor and gear set (as shown in FIG. 2), forward guide pin 16, and driving wheels 18. A rear guide pin 20 may be provided, as shown. The sub body can be concealed beneath a box 19, as above. A larger-scale visible body 22' is supported near its forward end on a pivot 40, defining a vertical axis about which body 22' can pivot with respect to sub body 10. In this embodiment, the pivot is sufficiently tall that very large-scale front wheels 30, supported for free rotation on an axle 34 carried by chassis 12, fit entirely beneath the visible body 22'; large-scale rear wheels 32 are supported for free rotation on axle 36 carried by chassis 12.

In use the Monster Truck I operates much as the Sprint Car of FIGS. 1 and 2; in turns, the visible body 22' and rear wheels 32 swing outwardly, while the front wheels 30 remain aligned with the sub body 10 and hence the direction of travel, providing a very pleasing impression of a broadsliding truck being countersteered to remain under control.

Figure 4:
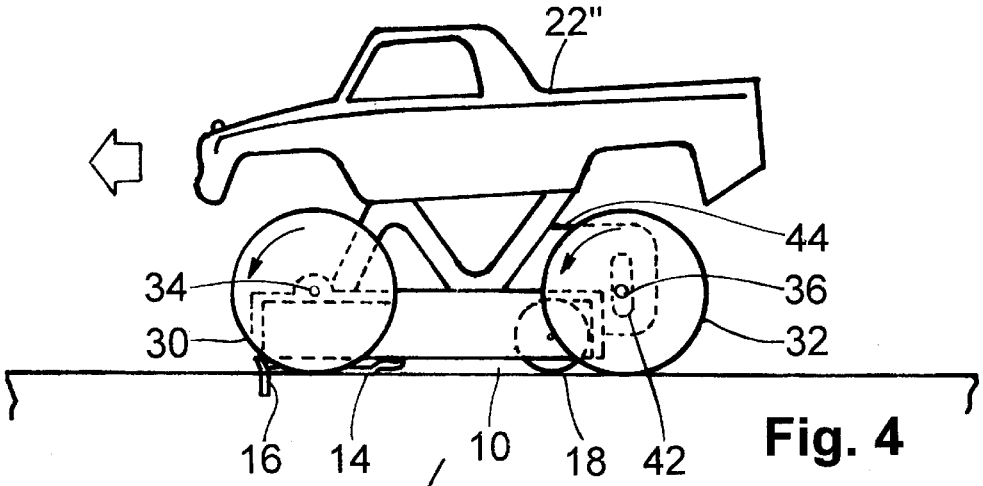
FIG. 4 shows a side view of the Monster Truck II, illustrating a second implementation of the invention.

It is within the scope of the invention, contrary to the embodiment of FIGS. 1–3, to affix the axle 34 carrying the large-scale front wheels 30 to the body 22, and to fix the visible body to the sub body. Similarly in contrast to the arrangement discussed above, the rear guide pin 20 is not required in all cases. FIG. 4 shows a Monster Truck II according to these variations on the invention. As the body 22" is not pivoted with respect to the sub body 10 and a rear guide pin 20 is not provided, both the sub body 10 and the body 22" swing outwardly in turns, providing the broadsliding appearance. Both front and rear large-scale wheels 30 and 32 are carried by body 22", and are again rotated only by frictional drag encountered when they contact the surface of the track. Rear wheels 32 are fixed to an axle 36 carried in vertical slots 42 formed in spaced support members 44 which will typically also support body 22" on sub body 10; slots 42 allow axle 36 to move vertically freely. Accordingly, wheels 32 can move upwardly in the event of irregularities in the surface of the track without interfering with traction between drive wheels 18 and the track. Further, because body 22" is not pivoted with respect to sub body 10, rear wheels 32 can overlap the rear end of sub body 10 without interference, allowing a relatively short-wheelbase appearance. By comparison, as shown by FIGS. 1, 2, and 3, the rear wheels of the Sprint Car and Monster Truck I must be spaced such that they do not contact sub body 10 as the respective bodies 22, 22' pivot with respect to the sub body 10. In this embodiment the advantages of providing large-scale bodies on smaller scale drive machanisms are realized, as above.

Figure 5:
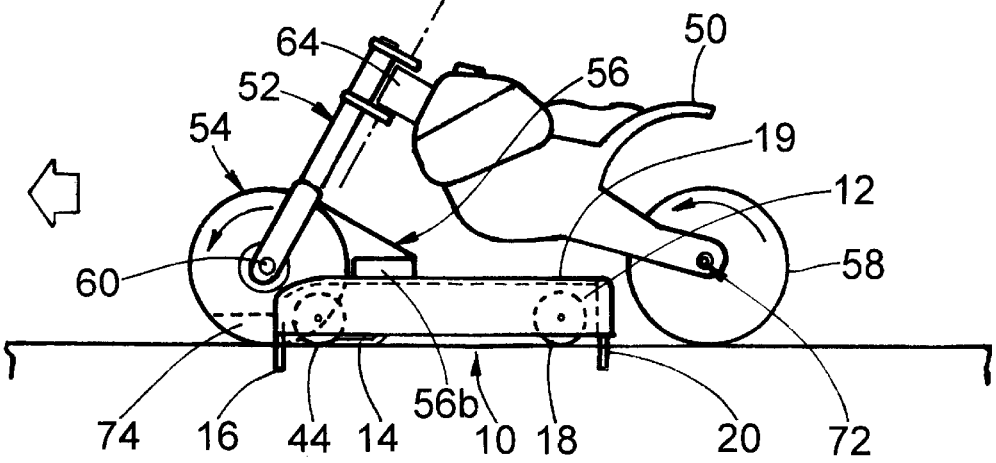
FIG. 5 shows a side view of the Motorcycle, illustrating a third implementation of the invention.
Figure 6:
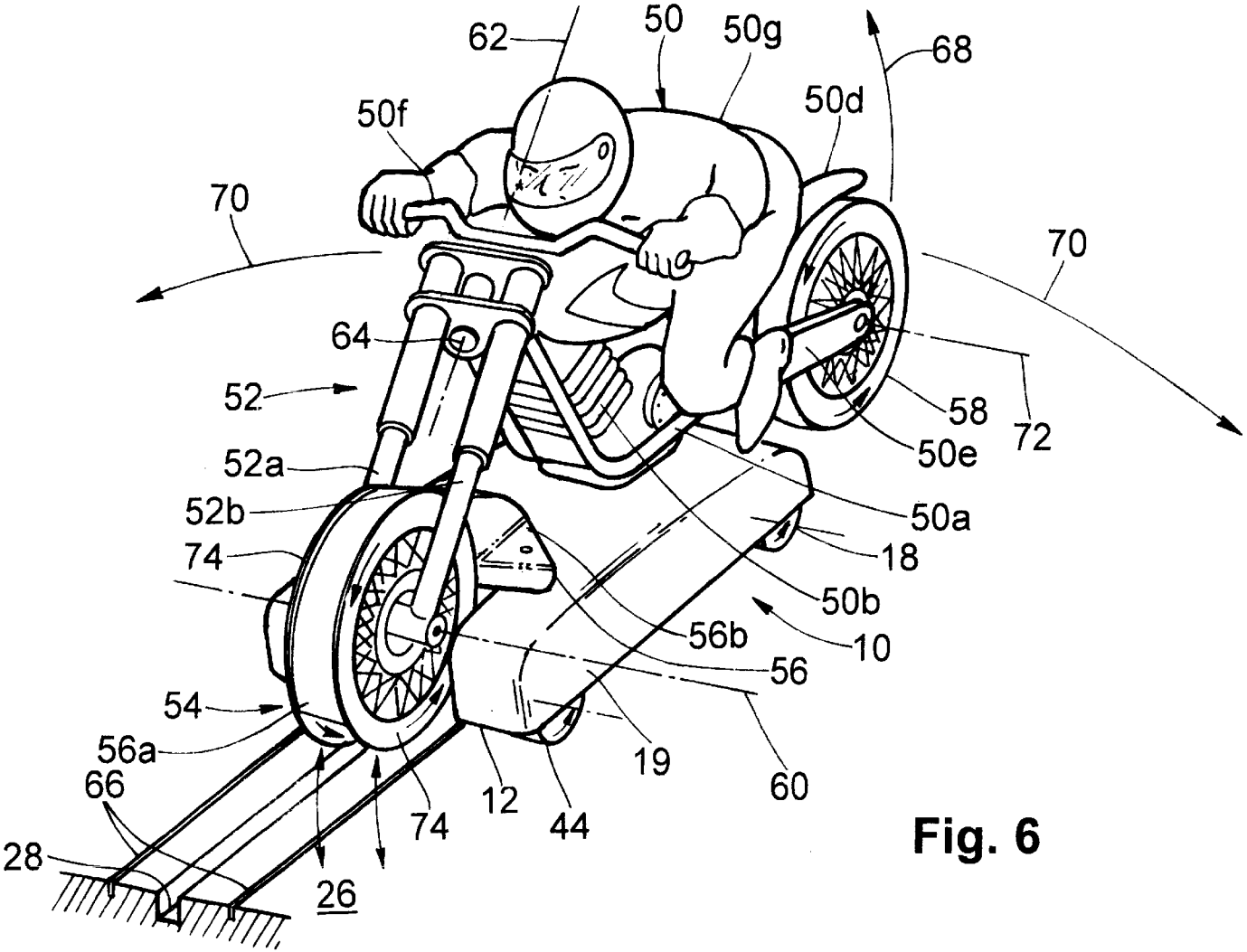
FIG. 6 shows a perspective view of a slightly different embodiment of the Motorcycle, further clarifying its operation over a track.

A further embodiment of the invention, the Motorcycle, is shown by FIGS. 5 and 6. (There are minor differences between the implementations of the Motorcycle as shown in FIGS. 5 and 6; these further illustrate the scope of the invention.) As shown by FIG. 5, the Motorcycle again comprises a sub body 10 comprising a chassis 12, pickup shoes 14, a forward guide pin 16, a motor and gear set (as shown by FIG. 2), driving wheels 18, and a rear guide pin 20. In this case, the sub body may also comprise front wheels 44; these are also optional in the other embodiments of the invention. The Motorcycle also comprises three principal "visible" components, all relatively large-scale models: a front wheel 54, a telescopic fork assembly 52, and a component 50 modeling the frame **50*a*, engine 50*b*, fuel tank 50*c*, seat and fender 50*d*, swing arm 50*e* (carrying rear wheel 58), handlebar 50*f*, and rider 50*g***, as well as any other items desired to be modeled. Each of these three principal components will typically be made up of individual items that are subsequently assembled.

In the presently preferred embodiment of the Motorcycle, the front wheel 54 rotates freely about a pivot axis 60, effectively that of the front axle, as the Motorcycle traverses the track; this pivot axis 60 is fixed with respect to the sub body 10. In order that the remainder of the Motorcycle can pivot upwardly with respect to the sub body, as indicated by arrow 68, e.g., if the rear wheel encounters a bump in the track, so as not to disturb the traction of the driving wheels 18 on the track, and to allow for realistic jumping action, the fork assembly 52 is mounted to pivot about axis 60, and remains aligned with front wheel 54. Component 50, comprising as noted models of the frame, engine, tank, seat, swing arm carrying rear wheel, handlebar, and rider, is pivoted freely with respect to the fork assembly 52 about a centerline 62, defined by a pivot pin 64. Centerline 62 is in the plane of the longitudinal centerline of the sub body 10, but is inclined rearwardly from the vertical by on the order of 20–45°, comparable to the angle made to the vertical by the steering head of a typical motorcycle. Thus component 50 pivots side-to-side, as indicated by arrows 70.

In operation, as the Motorcycle traverses a curve on the track, the front wheel 54 and fork assembly 52 remain aligned with the sub body 10, and do not lean. The component 50, however, having its forward end restrained from rotation against centripetal force by pivot pin 64, but its rear end free, tends to swing outwardly; moreover, as the centerline of pivot pin 64 is inclined rearwardly, component 50 leans over, simulating the leaning action of a motorcycle quite convincingly.

Those of skill in the art of motorcycle dynamics will recognize that the "broadsliding" action provided by the toy motorcycles of the invention is perhaps more appropriate for modeling a motorcycle sliding on dirt, where the front wheel tends to be more upright than the rear wheel, than a motorcycle cornering on pavement, where the front and rear wheels are very close to parallel. Similarly, in a "real" motorcycle, the handlebars remain aligned with the fork assembly, while those of the Motorcycle of the invention (in its present embodiment) pivot with the component 50; to fix the handlebars 50*f* to fork assembly 52 would have involved significant additional complexity, since the rider 50*g* would then have had to be reconfigured to negotiate a turn.

As noted above, the rear wheel 58 of the Motorcycle is carried by swing arm 50*e*; rear wheel 58 is freely pivoted on swing arm 50*e*, and is rotated about its axis 72 by friction encountered as it contacts the surface of track 26.

As indicated above, the pivot axis 60 about which front wheel 54 and fork assembly 52 are both pivoted is fixed with respect to sub body 10. It would be functionally sufficient to pivot these items on a pin or the like carried by ears formed on the top of sub body 10, e.g., molded into a box 19 shrouding the sub body 10. However, doing so would conceal a substantial portion of the front wheel 54.

Therefore, in a preferred embodiment, the pivot 60 is defined by a hole (not shown) in a bracket member 56, comprising a base portion 56*b* fixed to the upper surface of box 19 and a disc-shaped carrier portion 56*a* fitting between paired wheel halves 74. A pin extending between the lower ends of the fork legs 52*a*, 52*b* and through the hole in carrier portion 56*a* thus carries wheel halves 74, which are molded and painted to resemble wheels and tires. The disc-shaped carrier portion 56*a* extending between wheel halves 74 may be painted to match the tire portion of wheel halves 74, and the base portion 56*b* colored to match the box 19, itself colored to match the track, all to minimize the visual impact of the sub body and emphasize the modeled Motorcycle. The lowermost portion of disc-shaped carrier portion 56*a* extending between wheel halves 74 is cut away, providing clearance so that the wheel halves 74 contact the track surface and are rotated thereby. A stop (not shown) may be molded into the lower end of one of the fork legs 52*a*, 52*b* to contact the box 19, limiting the upward travel of the fork and component 50 about axis 60, and stabilizing the Motorcycle over jumps.

While several preferred and alternative embodiments of the invention have been described in detail, the invention is not to be limited thereby, but only by the following claims.

What is claimed is:

1. A toy racing car or other vehicle intended to be operated on a track defining a surface and comprising a pair of conductors on either side of a groove formed in said surface of said track, comprising:

a sub body, comprising a chassis, a pair of drive wheels, a pair of current pickup devices, a motor connected to said pickup devices and driving said drive wheels through a gear set, a first guide pin disposed toward a forward end of said chassis, and a second guide pin disposed toward a rearward end of said chassis, such that in use said guide pins fit within said groove and said pickup shoes contact said conductors, and a visible body mounted to said sub body at a pivot point defining a substantially vertical pivot axis near the forward end of said chassis, and not constrained to follow said groove, whereby said visible body can pivot freely with respect to said sub body about said substantially vertical pivot axis, and having at least one set of freely rotating simulated drive wheels, said freely rotating simulated drive wheels being spaced rearwardly from said vertical pivot axis by a distance sufficient that said simulated drive wheels clear the rearward end of said chassis as the visible body pivots with respect to said sub body.

2. The toy racing car or other vehicle of claim 1, wherein said chassis, said pair of drive wheels, said pair of current pickup devices, said motor and said gear set, and said first guide pin are standard components designed for toy racing cars of a predetermined scale and adapted to operate on track having corresponding dimensions.

3. The toy racing car or other vehicle of claim 2, further comprising a second set of freely rotating simulated drive wheels mounted to said sub body.

4. The toy racing car or other vehicle of claim 2, further comprising a second set of large scale freely rotating simulated drive wheels mounted to said visible body, and wherein said visible body is fixed to said sub body.

5. The toy racing car or other vehicle of claim 4, wherein said at least one set of freely rotating simulated drive wheels are mounted to said visible body by an axle extending therebetween and confined within a pair of spaced vertical slots formed in mounting members fixed to said visible body.

6. A toy racing motorcycle intended to be operated on a track comprising a pair of conductors on either side of a groove formed in said track, comprising:

a sub body, comprising a chassis, a pair of drive wheels, a pair of current pickup devices, a motor connected to said pickup devices and driving said drive wheels through a gear set, a first guide pin disposed toward a forward end of said chassis, and a second guide pin disposed toward a rearward end of said chassis, such that in use said guide pins fit within said groove and said pickup shoes contact said conductors, and a front wheel mounted for free rotation about an axis at the forward end of said sub body, a front fork assembly comprising a pair of fork legs disposed on either side of said front wheel, and defining a pivot in the plane of the long axis of said sub body and inclined rearwardly with respect to the vertical, and a component comprising elements simulating at least the frame and rider of a motorcycle, including a rear wheel thereof, said component being mounted to said front fork assembly for free pivoting about said pivot defined thereby, and not constrained to follow said groove, said component being sized such that said rear wheel thereof extends rearwardly beyond the rearward end of said chassis, whereby in use said component comprising elements simulating at least the frame and rider of a motorcycle can pivot freely from side to side with respect to said sub body.

7. The toy racing motorcycle of claim 6, wherein said chassis, said pair of drive wheels, said pair of current pickup devices, said motor and said gear set, and said first guide pin are standard components designed for toy racing cars of a predetermined scale and adapted to operate on track having corresponding dimensions.

8. The toy racing motorcycle of claim 6, wherein said front wheel comprises a pair of wheel halves disposed on either side of a bracket member affixed to said sub body, and wherein a pivot pin passes through the lower ends of said fork legs, said wheel halves, and a hole in said bracket member and thereby defines the axis at the forward end of said sub body about which said front wheel rotates, and wherein said front fork assembly and said component comprising elements simulating at least the frame and rider of a motorcycle similarly pivot freely about said axis.

9. The toy racing motorcycle of claim 8, wherein said sub body is effectively concealed beneath a shrouding box, and said bracket member is affixed to said box.

10. The toy racing motorcycle of claim 6, wherein said pivot in the plane of the long axis of said sub body and inclined rearwardly with respect to the vertical defined by said front fork assembly is inclined rearwardly at between about 20° and about 45° to the vertical.

11. A toy racing car or other type of vehicle configured to operate on a track defining a surface and including a pair of conductors on either side of a groove formed in said surface of said track, the toy vehicle comprising:

a sub body including a chassis, at least one surface contacting and chassis supporting wheel, a pair of current pickup devices, a motor connected to the pickup devices and connected to the at least one wheel through a gear set to drive at least the one wheel in a forward direction, a first guide pin disposed towards a forward end of said chassis, and a second guide pin disposed towards a rearward end of said chassis, said pickup shoes being located to contact said conductors when said guide pins are fitted within said groove, and a visible body pivotally coupled to said sub body at a single pivot near the forward end of said chassis and of a length sufficient to extend rearwardly from the single pivot over the sub body, the second guide pin and rearward end of the chassis, the visible body including at least one freely rotating, surface contacting rear wheel supporting the visible body on the surface, the visible body being constrained from lateral movement across the surface only by the pivot to the sub body, and each rear wheel of the visible body being spaced rearwardly from the pivot by a distance sufficient that each rear wheel of the visible body clears the sub body at the rearward end of the chassis as the visible body pivots side to side over the sub body about the pivot.

12. The toy vehicle of claim 11 wherein the sub body includes a second surface contacting wheel forming a first pair with the at least one wheel and driven by the motor through the gear set.

13. The toy vehicle of claim 11 wherein the sub body includes a second pair of surface contacting and chassis supporting wheels spaced longitudinally from the first pair of motor driven wheels.

14. The toy vehicle of claim 13 wherein the pivot point is located directly over a centerline through the pair of wheels nearer the forward end of the chassis.

15. The toy vehicle of claim 11 being a motorcycle wherein the visible body includes elements simulating at least a frame of the motorcycle, the rear wheel of the visible body being mounted to the frame, and a rider.

16. The toy vehicle of claim 15 wherein the sub body includes a simulated front motorcycle wheel mounted at a forward end of the chassis and a front fork assembly including a pair of fork legs disposed on either side of the simulated motorcycle wheel, the pivot coupling to the visible body being located on the front fork assembly.

17. The toy vehicle of claim 16 wherein the simulated front motorcycle wheel includes at least one freely rotating component in contact with the surface so as to rotate with movement of the vehicle along the surface.

* * * * *